US005747117A

United States Patent [19]

Dannenberg

[11] Patent Number: 5,747,117

[45] Date of Patent: May 5, 1998

[54] METHOD OF APPLYING A FILM TO A SUBSTRATE

[75] Inventor: Rand Dannenberg, Huntington, N.Y.

[73] Assignee: Servo Corporation of America, Westbury, N.Y.

[21] Appl. No.: 869,130

[22] Filed: Jun. 4, 1997

[51] Int. Cl.[6] ..... H05H 1/00

[52] U.S. Cl. ..... 427/535; 427/259; 427/264; 427/270; 427/272; 427/282; 427/385.5; 427/404; 427/407.1; 427/534; 427/539; 427/560; 427/600

[58] Field of Search ..... 427/535, 259, 427/264, 270, 272, 282, 385.5, 404, 407.1, 534, 539, 560, 600

*Primary Examiner*—Bernard Pianalto
*Attorney, Agent, or Firm*—Kane, Dalsimer, Sullivan, Kurucz, Levy, Eisele and Richard, LLP

[57] ABSTRACT

A film is applied to a substrate in accordance with a predetermined pattern by applying a solution of a copolymer of fluoropolymers dissolved in a solvent onto the surface of the substrate; curing and annealing the solution to boil off the solvent and form a copolymer film on the substrate; depositing a thin metal film on the copolymer film; patterning the thin metal film by a photoresist etching process to expose the underlying copolymer film in accordance with the predetermined pattern; removing the exposed copolymer film so that the underlying substrate is exposed in accordance with the predetermined pattern; removing any remaining thin metal film; depositing the film to the remaining copolymer film and exposed substrate; then removing the remaining copolymer film and any film applied thereon by ultrasonic cleaning.

9 Claims, 2 Drawing Sheets

METHOD OF APPLYING A FILM TO A SUBSTRATE

BACKGROUND OF THE INVENTION

1. Field of the Invention

This invention relates to a method of applying a film to a substrate in accordance with a predetermined pattern, and, more particularly, to a photolithographic method employing a "break off" copolymer.

2. Description of the Prior Art

Photolithographic processes are typically used apply a film to a substrate in accordance with a predetermined pattern. Such processes are used, for example, in manufacturing sensors and microprocessors. In known processes, a polymer film is applied to the substrate so that the substrate is exposed in accordance with the predetermined pattern. The film is then deposited onto the polymer film and exposed surfaces of the substrate. The polymer film and any film deposited thereon are removed by dissolving the polymer film in a solvent, leaving behind the film which was deposited onto the substrate. Polymers used in such processes have become known as "lift-off" polymers and are known to become chemically inert after exposure to a temperature of 300 degrees Celsius for more than three hours. Thus, lift-off polymers cannot be dissolved after exposure to such temperatures, and lift-off techniques cannot be utilized in processes requiring temperatures in excess of 300 degrees Celsius.

Therefore, in order to alleviate these problems, an objective of the present invention is to provide a method of applying a film to a substrate in a predetermined pattern which can be used in a high-temperature environment.

SUMMARY OF THE INVENTION

The above and other beneficial objects are obtained in accordance with the present invention by providing a method of applying a film to a substrate in a predetermined pattern by applying a "break-off" copolymer to the substrate; curing and annealing the copolymer; depositing a thin metal film onto the copolymer; patterning the thin metal film by a standard photoresist process to expose the underlying copolymer in accordance with the predetermined pattern; removing the exposed copolymer so that the substrate is exposed in accordance with the predetermined pattern; removing any remaining thin metal film; depositing the film onto the remaining copolymer and exposed substrate; and then removing the "break-off" copolymer and any film deposited thereon by ultrasonic cleaning. Thus, the film remains on the substrate in accordance with the predetermined pattern.

DETAILED DESCRIPTION OF THE PREFERRED EMBODIMENTS

The aforementioned figures illustrate the method of applying a film 18 to a substrate 10 in accordance with a predetermined pattern in which identical numerals in each figure represent identical elements.

Figure 1:
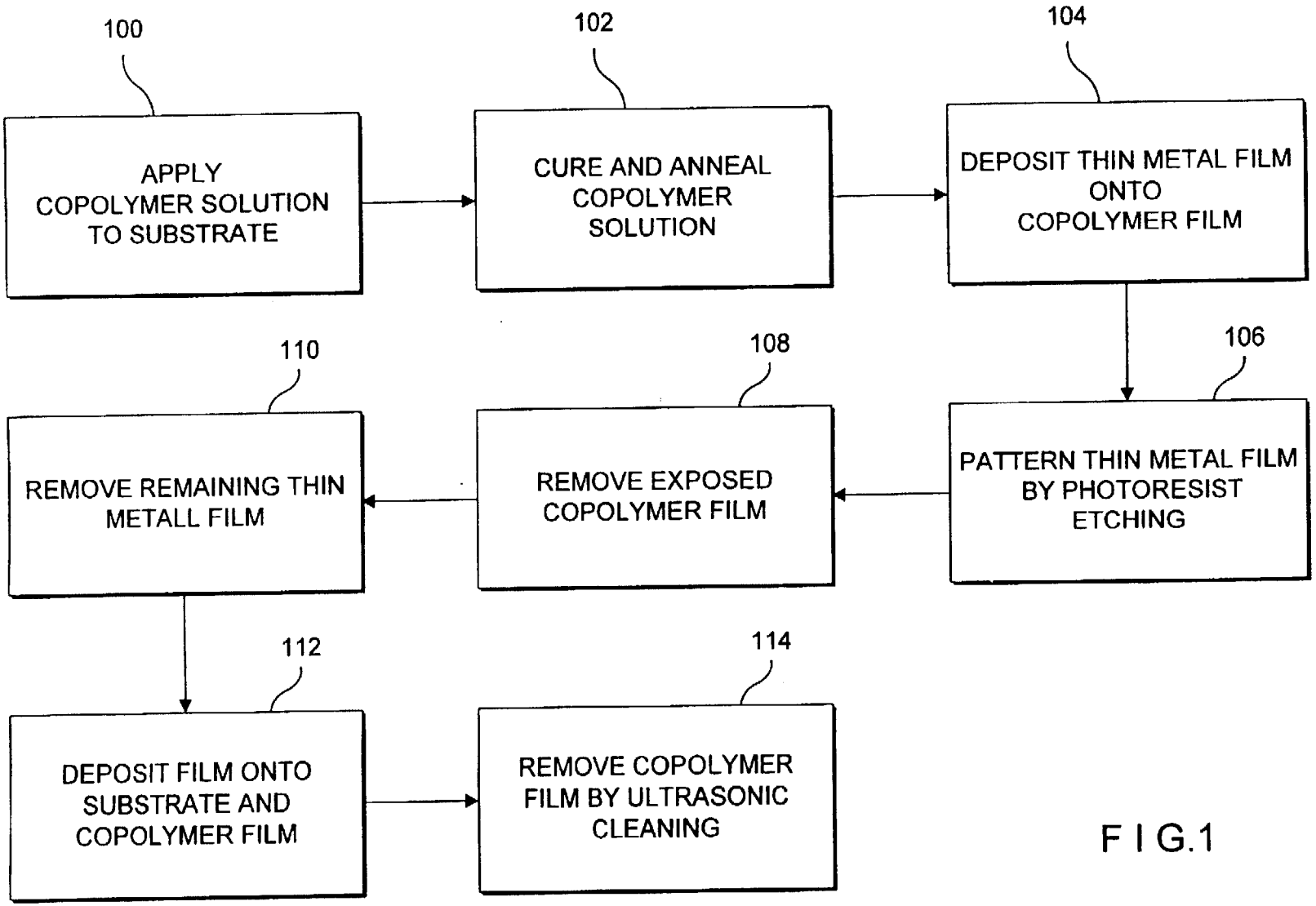
FIG. 1 shows a block diagram of the method according to the present invention.
Figure 2:
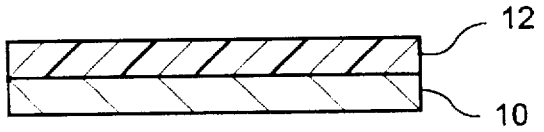
FIG. 2 is a cross-sectional view of a substrate and copolymer solution after completion of the first step of the method according to the present invention.

FIG. 1 illustrates a block diagram of the method of applying a film 18 to a substrate 10 in accordance with the present invention. First, in step 100, a solution 12 is deposited onto the surface of the substrate 10 as illustrated in FIG. 2. The solution 12 may be deposited onto the substrate 10 by any method which will provide for a uniform thickness of the solution 12. Preferably, spin casting is used to deposit the solution 12 onto the surface of the substrate 10 because spin casting provides a method of applying a highly uniform thickness of the solution 12. The thickness of the deposited solution 12 will depend upon the spin speed and viscosity of the solution 12. The solution 12 deposited on the substrate 10 is preferably a copolymer of fluoropolymers dissolved in a solvent. More specifically, solution 12 is preferably a copolymer composed of 75% polyvinylidene fluoride (PVDF) and 25% trifluoroethylene (TrFE), that is, P(VDF-TrFE), dispersed in methyl ethyl ketone (MEK).

The viscosity of the solution 12 is determined by the ratio of the copolymer to the solvent. The viscosity of the solution 12 can be optimized based upon the particular thickness of film 18 to be applied, the detail and resolution of the predetermined pattern, as well as other factors. It should be understood that a relatively high viscosity solution 12 should be used in applying a relatively thick layer of film 18; and that a relatively low viscosity solution 12 should be used in applying a relatively thin layer of film 18 or where the predetermined pattern has a fine resolution.

Next, in step 102, the solution 12 is baked to cure and anneal the copolymer and to boil off the solvent. P(VDF-TrFE) can be cured and annealed at 300 degrees Celsius in air for one hour. Once the baking step is completed, a dry copolymer film 14 remains on the surface of the substrate 10.

Figure 3:
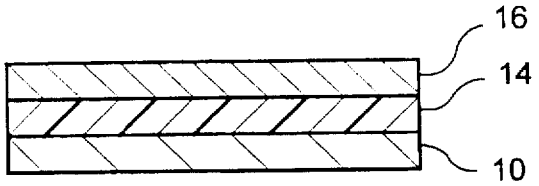
FIG. 3 is a cross-sectional view of the substrate, copolymer film and thin metal film after completion of the third step of the method according to the present invention.

Next, in step 104, a thin metal film 16 is applied to the copolymer film 14. A thickness of 1,000 angstroms (Å) of gold, deposited by evaporative techniques, has been used as thin metal film 18. FIG. 3 illustrates a cross-sectional view of the thin metal film 16 applied to the copolymer film 14. Thin metal film 16 is then patterned in step 106 by a standard photoresist etching process. That is, portions of thin metal film 16 are removed so that the underlying copolymer film 14 is exposed in accordance with the predetermined pattern.

Figure 4:
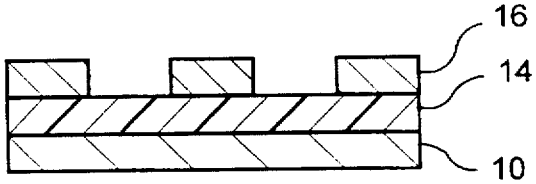
FIG. 4 is a cross-sectional view of the substrate, copolymer film and thin metal film after completion of the fourth step of the method according to the present invention.

Shipley 1813 photoresist, spun onto the surface of thin metal film 16 at 1,500 r.p.m., has successfully been used as the photoresist in step 106. The photoresist was then evaporated at a temperature of 100 degrees Celsius for sixty seconds. After the photoresist was exposed to 85 millijoules-per-square-meter ($mJ/m^2$), the photoresist was developed in Shipley MF322 developer for approximately fifteen seconds. FIG. 4 illustrates the thin metal film 16, copolymer film 14 and substrate 10 after completion of the photoresist etching process.

Figure 5:
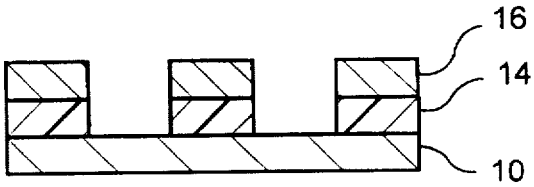
FIG. 5 is a cross-sectional view of the substrate, copolymer film and thin metal film after completion of the fifth step of the method according to the present invention.
Figure 6:
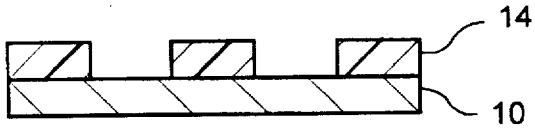
FIG. 6 is a cross-sectional view of the substrate and copolymer film after completion of the sixth step of the method according to the present invention.

Next, in step 108, the exposed areas of the copolymer film 14 are removed, thereby exposing the underlying substrate 10 in accordance with the predetermined pattern. FIG. 5 illustrates the thin metal film 16, copolymer film 14 and substrate 10 after completion of step 108. Preferably, the exposed areas of the P(VDF-TrFE) copolymer film 14 are removed by plasma ashing in oxygen. Any remaining thin metal film 16 is then removed, in step 110, from the copolymer film 14. When gold is used as the metal of thin metal film 16, an iodine-based gold etchant may be used is step 110 to remove any remaining thin metal film 16. FIG. 6 illustrates the copolymer film 14 and substrate 10 after completion of step 110.

Figure 7:
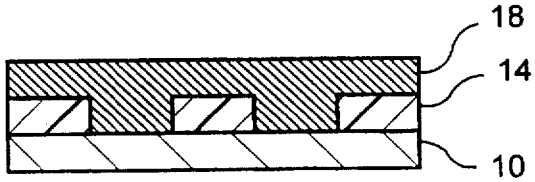
FIG. 7 is a cross-sectional view of the substrate, copolymer film and film after completion of the seventh step of the method according to the present invention.
Figure 8:
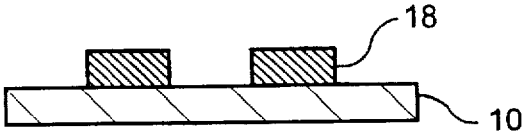
FIG. 8 is a cross-sectional view of the substrate and film after completion of the eighth step of the method according to the present invention.

Next, in step 112, the film 18 is deposited, for example by sputtering or evaporation, onto the exposed surface of the substrate 10 and onto the surface of the remaining copolymer film 14. Acetone may optionally be used to rinse the surface of the copolymer film 14 prior to depositing the film 18. FIG. 7 illustrates the film 18 deposited onto the substrate 10 and copolymer film 14. Finally, in step 114, the remaining copolymer film 14 and any film 18 deposited thereon are removed by breaking the copolymer film 14 from the surface of the substrate 10 by ultrasonic cleaning. The remaining copolymer film 14 and any film 18 deposit thereon has successfully been removed by ultrasonic cleaning in water for a duration of approximately five minutes. Thus, as illustrated in FIG. 8, the film 18 remaining on the substrate 10 after completion of step 114 corresponds to the predetermined pattern.

Thus the aforementioned objects and advantages are most effectively attained. Although a singled preferred embodiment of the invention has been disclosed and described in detail herein, it should be understood that this invention is in no sense limited thereby and its scope is to be determined by that of the appended claims.

I claim:

1. A method of depositing a film onto a substrate in accordance with a predetermined pattern, comprising the steps of:

applying a solution onto a surface of a substrate, said solution being composed of a copolymer dissolved in a solvent;

curing and annealing said solution to form a copolymer film on said surface of said substrate;

depositing a thin metal film onto said copolymer film;

removing a portion of said thin metal film corresponding to said predetermined pattern so that said copolymer film is exposed in accordance with said predetermined pattern;

removing exposed surfaces of said copolymer film so that said substrate is exposed in accordance with said predetermined pattern;

removing any of said thin metal film remaining on said copolymer film;

depositing a film onto said substrate and said copolymer film; and removing said copolymer film from said substrate and any of said film deposited on said copolymer film so that said film remains on said substrate in accordance with said predetermined pattern.

2. The method according to claim 1, wherein said copolymer is composed of fluoropolymers.

3. The method according to claim 2, wherein said copolymer composed of polyvinylidene fluoride and trifluoroethylene.

4. The method according to claim 3, wherein said copolymer is composed of 75% polyvinylidene fluoride and 25% trifluoroethylene.

5. The method according to claim 4, wherein said solvent is methyl ethyl ketone.

6. The method according to claim 5, wherein said solution is cured and annealed at 300 degrees Celsius in air for one hour.

7. The method according to claim 6, wherein said portion of said thin metal film corresponding to said predetermined pattern is removed by photoresist etching.

8. The method according to claim 7, wherein the exposed surfaces of said copolymer film are removed by plasma ashing in oxygen.

9. The method according to claim 8, wherein said copolymer film and said film deposited on said copolymer film are removed by ultrasonic cleaning.

* * * * *